United States Patent [19]

Trepaud

[11] 3,989,105

[45] Nov. 2, 1976

[54] HEAT EXCHANGER

[76] Inventor: Georges Trepaud, 1 Rond-Point Bugeaud, 75016 Paris, France

[22] Filed: Nov. 14, 1974

[21] Appl. No.: 523,891

Related U.S. Application Data

[63] Continuation-in-part of Ser. No. 332,761, Feb. 15, 1973, abandoned.

[30] Foreign Application Priority Data

Feb. 22, 1972 France ..... 72.05913
Nov. 30, 1972 France ..... 72.42590

[52] U.S. Cl. ..... 165/158; 165/162; 122/32

[51] Int. Cl.[2] ..... F28D 7/10; F22B 1/06; F28F 9/00

[58] Field of Search ..... 165/158–162; 122/32, 34

[56] References Cited

UNITED STATES PATENTS

| | | | |
|---|---|---|---|
| 1,992,504 | 2/1935 | Penniman | 165/162 |
| 3,147,743 | 9/1964 | Romanus | 122/32 |
| 3,212,570 | 10/1965 | Holman | 165/162 |
| 3,336,974 | 8/1967 | Bernstein et al. | 165/162 |
| 3,626,481 | 12/1971 | Taylor | 165/162 |
| 3,635,287 | 1/1972 | Sprague | 165/158 |
| 3,700,030 | 10/1972 | Busquain et al. | 122/32 |
| 3,741,167 | 6/1973 | Polcer et al. | 122/32 |
| 3,771,596 | 10/1971 | Schlichting | 165/158 |

*Primary Examiner*—Charles J. Myhre
*Assistant Examiner*—Theophil W. Streule, Jr.
*Attorney, Agent, or Firm*—Robert E. Burns; Emmanuel J. Lobato; Bruce L. Adams

[57] ABSTRACT

A heat exchanger wherein the heat-exchanging structure comprises a light-weight assembly of undulated tubes in the form of an annular bundle located between a heavy cylindrical outer shell and a frangible central shaft, the ends of the tubes being fitted in drilled inlet and outlet heads fixed at the ends of the outer shell and the tubes being supported within the outer shell by co-axial hoops and radial braces.

10 Claims, 16 Drawing Figures

HEAT EXCHANGER

This is a continuation-in-part application of my copending application Ser. No. 332,761 filed Feb. 15, 1973 for an improvement in Heat EXCHANGER.

The present invention relates to a large sized heat exchanger, especially suitable at high temperatures and pressures, which can be used in particular as a steam generator in which one of the fluids, e.g. pressurised hot water which has been used for cooling a nuclear reactor, passes through the tubes of the exchanger fitted inside a shell, whilst the water to be vaporized circulates in the aforesaid shell in contact with these tubes. The invention can also be applied to steam superheater-exchangers for heavy turbines and to recuperative exchangers, as well as applications in which the heat-carrying fluid, particularly a molten metal such as sodium, circulates in contraflow along and around the tubes through which the water to be vaporised runs.

It is known that various types of steam generator have already been proposed, the most commonly used at present being the natural circulation U-tube generator with reheating of the secondary feedwater by steam take-off and mechanical separation of the steam and the liquid in a very large drying dome.

Such a layout has a certain number of disadvantages. It leads first of all to the adoption of tubes which are not all identical, the differences lying basically in the various radii of curvature required to achieve the bundle of U-tubes. In particular, some of the tubes — positioned close to the axis of the device — have a very low radius of curvature and are therefore particularly fragile at this point; this disadvantage is all the more serious since it is not possible to replace defective tubes which are inaccessible.

In another known embodiment of tube exchanger using the principle of forced circulation of the water to be vaporised and superheating, straight tubes are fitted at each end into holes in thick plates forming the bases of two heads comprising respectively intake and outlet openings for the fluid passing through the tubes, in particular the hot fluid passing through the tubes from top to bottom, whilst the water to be vaporised is brought into the device in the vicinity of the bottom drilled plate. The great thickness of the plates into which the tubes are fitted, which takes into account the mechanical stresses to which they are subjected, has the effect of giving rise in the bottom plate to a high thermal gradient and therefore to high thermal stresses because the upper side is at the temperature of the cold secondary water, whilst the lower side is subjected to the even higher temperature of the primary fluid coming out of the tubes.

In addition, in all known embodiments the tubes are held in place to prevent them from vibrating by transverse plates which are drilled for passage of the tubes and which also have openings for passage of the liquid circulating in contact with the tubes; the result is that the tubes, whether they are U-shaped or straight, must be threaded through these drilled plates before being fitted and welded to the end plate or plates, which is a long and difficult job. The threading of the tubes through the drilled supporting plates and the welding thereof to the end plate or plates must be obviously performed outside the outer shell. The end plates must be then assembled with and welded to the outer shell and to the heads of the exchanger; the welding occurs by preheating the assembled parts to 200°–300° C and making circular welds requiring a local temperature of 1300° to 1400° C. These welds cause tension in the plates which has to be stabilised by annealing at 600° C which is often harmful to the durability of the tubes of the bundle, especially to the welds between the ends of the tubes and the end plates.

In addition the openings in the plates for passage of the fluid circulating in contact with the tubes generally mean a relatively small section of the fluid passing through causing a high passage speed and a substantial loss of head.

The present invention relates to a heat exchanger in which all these disadvantages are eliminated. This heat exchanger is characterised by the fact that it includes in combination, on the one hand a heavy outer structure consisting of a cylindrical outer shell fixed at each end to an annular intake head and a annular outlet head for one of the fluids, the internal bases of these heads being drilled and the parts of this structure being assembled, welded and stabilised in advance, a light inner structure then being fitted into the outer structure and consisting of tubes inserted by their ends into the holes in the aforesaid bases and arranged in concentric layers in an annular bundle making a wide central passage accessible through the axial cylindrical openings of the annular heads for installation of the aforesaid tubes, beginning with the peripheral layer next to the outer shell, the concentric layers of tubes being held in several transverse planes by concentric rows of hoops arranged between these layers and interlocked with them by regularly distributed radial braces welded as they are fitted, an annular exchange chamber being formed between the outer cylindrical shell and a wide central shaft extending over more or less the whole height of the bundle and fitted after it, this shaft being made of thin sheet metal so that it can be broken to allow access to the bundle with a view to carrying out repairs or replacement of the tubes.

The central space limited by said shaft has a diameter of the order of 1.5 m allowing the parts of the inner structure to be easily introduced and fitted inside the outer structure.

To ensure free expansion of the tubes, they have over at least part of their length a quasi-sinusoidal undulating shape with arc deflections in alternately opposite directions, the angle of deflection preferably being equal to or less than 60° and fixed according to the maximum possible difference between the mean temperature of the tubes and the shell.

Calculations have shown that whereas with the temperature prevailing in heat exchangers of the kind involved, straight tubes are subjected due to expansion to a compression stress of 34 g/mm2, undulated tubes according to the invention having circular undulations extending over 60° are subjected to a bending stress of 3,4 kg/mm2 and a maximum longitudinal stress of 8 kg/mm2. Due to this important diminishing of stresses, the tubes may be made with a finer wall and in certain cases of an alloy cheaper than the INCONEL alloy generally used for heat exchanger tubes, for instance of INCOLOY 800.

The transverse planes in which the concentric hoops holding the tubes of the annular bundle are arranged, are placed either at the level of the points of inflexion or at the level of the peaks of the tubes the expansion of which means an increase in the curvature of the deflected parts giving rise to very much lower stresses than that of straight tubes.

The number and spacing of the planes holding the tubes is determined according to the dimensions of the tubes so as to prevent them starting to vibrate, and the number of deflections of the undulating tubes and the size of the camber of these deflections will be chosen according to this spacing.

As indicated above, one of the basic advantages of the exchanger according to the invention lies in the fact that it allows a new method for constructing large sized heat exchanger, said method which also forms part of the invention consisting first in assembling, welding and stabilizing the parts forming the heavy outer structure of the device, i.e., the top and bottom heads with their annular drilled bases and the outer shell. Then, taking advantage of the access offered by the axial passages of the heads and the wide central passage which will be formed in the centre of the annular bundle, the tubes can be fitted inside the device; for this purpose, first of all the outer retaining hoops with the greatest diameter are fixed into the shell, then one end of each tube of the first layer is inserted in the corresponding holes in one of the plates then, taking advantage of the flexibility of the undulating tubes, the other end of them is inserted in the holes in the other plate, then the retaining hoop of smaller diameter is put into position, welding the braces which are to interlock the two hoops and the tubes continue to be fitted in the same way as far as the layer with the smallest diameter, after which the smallest diameter retaining hoop and the central shaft are put into position, the ends of the tubes being welded in the holes of the end plates as they are positioned.

It is to be mentioned that the welding of the ends of the tubes in the holes of the end plates does not produce any internal thermal stresses in said plates which would require an annealing: these welds are made in a known manner which does not form part of the invention by providing on the outer face of the end plates a circular groove around each hole so as to form a relatively thin lip surrounding the ends of the tube, and then by fusing said lips which fill the surrounding groove. The welding being thus made by a very localized application of heat, though involving a temperature of the order of 800 ° to 900° C, no temperature gradient generating internal tensions is created in the plate.

Since the tubes have aligned straight pieces at the ends, their fitting is further facilitated by the fact that during the insertion of the tubes into the plates, the plane of their undulations can be positioned radially, then, once the tubes are inserted, they can be turned about the common axis of their straight ends to put them into the desired position with respect to the outer loop of the corresponding layer.

If the tube bundle is repaired or all or some of the tubes replaced, all that is necessary is to cut the central shaft of thin metal to gain access to the bundle from the wide central passage.

According to one embodiment the steam generator, the annular tube bundle of which is fed with pressurised hot water, includes a concentric double sleeve in the vicinity of the periphery of the annular bundle, the inner sleeve connected to the top annular tube plate, so that the outer sleeve stops at a certain distance from this plate and the bottom part of the annular space formed by the two sleeves is obturated with a ring, so that the secondary water brought into this annular space at its lower part around the tubes of the bundle which are housed in the aforesaid space and which pass through the ring, is reheated in rising circulation in counterflow to the primary water descending in the tubes then comes down again peripherally between the outer sleeve and the shell of the device reheating the latter, this reheated secondary water changing direction below the double sleeve to be brought up into the vaporising chamber between the inner sleeve and the central shaft.

The result of this is that the lower plate is no longer subjected to high thermal stresses and can be considerably reduced. Furthermore, by making the tube bundle long enough, the last part of the device where the steam already formed is in contact with the part of the tube in which the temperature of the pressurised primary water is at its maximum, can be used to superheat the steam which enables the device to be reduced economising on the heavy, bulky drying dome used in generators supplying saturated steam, as well as the mechanical droplet separators which it contains.

It should be noted that the increase in diameter of the annular bundle, compared with a non-annular bundle with the same surface, is negligible compared to the diameter of the central part made available taking into contact the advantages mentioned above.

In addition, the structure of the secondary feedwater reheater, as it is incorporated here in the generator in a simple, economical and effective way, allows a substantial increase in exchange surface by the effect of a circulation at the desired constant speed around the tubes of the bundle allocated to it in contraflow to the primary water, i.e., benefiting directly from the maximum logarithmic mean temperature difference between the two fluids, primary and secondary.

This is far from being the case in the system of reheating the water by steam take-off which entails roughly doubling the exchange surface for a proportion of 12–14% in general of the total heat transfer.

In the conditions most frequently encountered where the temperature of the primary water exceeds the vaporisation temperature by more than 50° C, whereas the vaporisation temperature itself also exceeds by 50° C the feedwater intake, it may be said that the exchange surface gain is about the same size as the extra surface required by the superheating, in spite of the poor surface transfer of the superheated steam.

This comes back to the same conclusion that the total exchange surface remains about the same, whereas:

the heavy, bulky construction of the drying dome, the mechanical separating devices and equipment which it contains and the cumbersome steam heating devices are eliminated.

As has already been indicated, in the generator according to the invention, all the tubes are identical, which is a manufacturing advantage, but also an operational one (same flows, same pressure losses, same temperatures). The large radii of curvature which allow substantial expansion do not involve excessive narrowing of the thickness of the tubes as in U-tube systems, so that in this respect thinner tubes may be used which improve exchanges. Indeed, it is known that the thermal resistance of the metal, depending on its thickness and thermal conductivity, enters very much into the coefficient K of total transfer in such generators where the fluids, and particularly the pressurised primary water, are exceptionally clean. Furthermore, designed to reduce stresses of thermal origin, the generator according to the invention imposes no special demands in the choice of materials of which it is made. Thus, in particular, the tube bundle could be adapted to a material other than INCONEL (normally used), if technical economic conditions showed it to be beneficial. In addition, it is found that each tube plate is at a constant temperature, the upper plate being at the inlet temperature of the hot pressurised primary water, whereas the lower plate is at the outlet temperature of the cooled pressurised primary water.

Due to the improvements forming part of this invention, a heat exchanger corresponding to a 450 MW power can be built having a total weight of 300 Tons, whereas a heat exchanger of conventional construction using U shaped tubes and having the same power has a weight of 420 tons. Furthermore, the exchanger of the invention generates a dry overheated steam, whereas the conventional exchanger generates a steam containing 0.25% moisture inspite the use of a large upper droplet separator and drying dome.

The description which follows together with the attached drawing relating to a generator with forced circulation, with single pass superheating, of the fluid, will make it clear how the invention can be applied.

Figure 1:
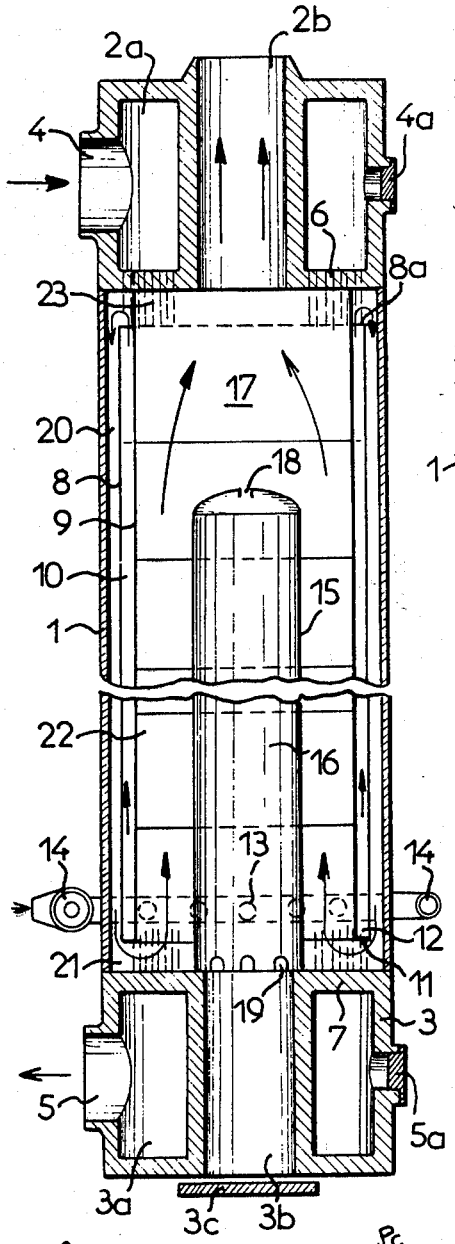
FIG. 1 is a schematic longitudinal section of a steam generator according to the invention.

The steam generator, shown in FIG. 1, comprises a cylindrical outer shell 1, arranged vertically and connected at each end to a top head 2 and a bottom head 3. Each head is annular in shape, i.e. it consists of an annular chamber 2*a*, 3*a* respectively, comprising therefore a hollow space forming a central passage 2*b* (and 3*b*).

A valve 3*c* obturates the central passage 3*b*. An opening 4 is arranged in the top head 2 for the intake of hot pressurised primary water into the annular chamber 2*a*. An opening 5 is arranged in the bottom head 3 for the removal of the cooled pressurised primary water from the annular chamber 3*a*. Inspection openings 4*a* and 5*a* respectively are arranged in the top and bottom heads 2 and 3.

The lower part of the top head 2 consists of an annular plate 6 while the upper part of the bottom head 3 also consists of an annular plate 7. Into these plates 6 and 7 are fitted the top and bottom end respectively of an annular bundle of flexible tubes shown schematically on the drawing by broken lines.

Figure 2:
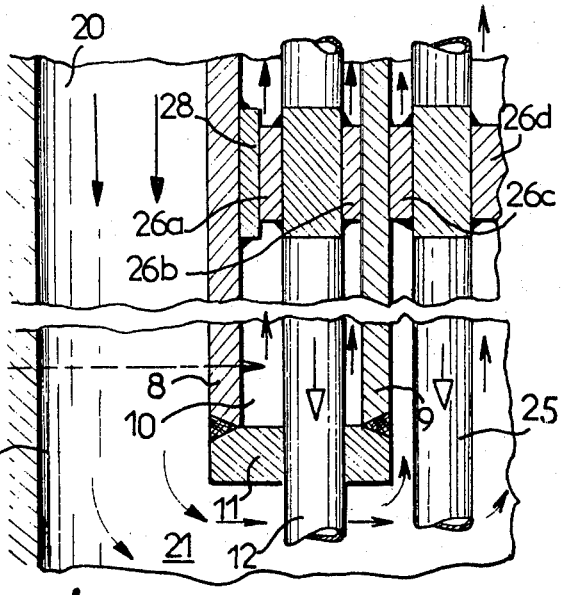
FIG. 2 is a larger scale detailed view showing the lower part of the secondary feed-water reheating section of the generator according to FIG. 1.

In the vicinity of the periphery of the annular tube bundle is arranged a concentric double sleeve consisting of an outer sleeve 8 and an inner sleeve 9, thus forming a secondary feedwater reheater. The inner sleeve 9 is connected to the annular tube plate 6, whereas the outer sleeve 8 stops at a certain distance from this plate as shown at 8*a*. The bottom part of the annular space 10 formed between the two sleeves 8 and 9 is obturated by a ring 11 drilled with holes for the passage of tubes and located at a certain distance from the lower annular tube plate 7. Tubes such as 12 (FIG. 2) belonging to the annular tube bundle are arranged in one or more cylindrical layers, in the space 10 between the two sleeves 8 and 9 and pass through the ring 11. Thus the design of the reheater is such that the two sleeves can expand freely.

In the lower part of the annular space 10 formed between the sleeves 8 and 9 secondary water is introduced through orifices 13 from a header 14.

A central sleeve 15 housed in the part made available by the annular arrangement of the bundle of flexible tubes, forms a shaft 16 in the axis of the central passage 3*b* of the bottom head 3. This shaft 16 extends over a limited height of the device thus leaving a free space 17 above it, which connects with the central passage 2*b* of the top head 2. With a view to allowing access to the tube bundle, the sleeve 15 is preferably made of thin sheet metal, which can thus easily be cut. In order to balance approximately the pressures on both sides of this thin sheet metal, holes are made in it. For example, a small opening 18 can be drilled at the top of the shaft 16, and openings 19 can be made at the bottom of it. If necessary it can be arranged that a slight overpressure exists inside the shaft 16, in order to lower the water level in it.

Thus the pressurised primary water is admitted hot a 4 into the annular chamber 2*a* of the top head 2, then it descends into the annular tube bundle passing through the plate 6 at the top and the plate 7 at the bottom, before being drained off at 5 from the annular chamber 3*a* of the bottom head 3.

The secondary water is introduced at the bottom part of the annular space 10 between the sleeves 8 and 9, from the header 14. This water is reheated by reascending in the annular space 10, i.e. in contraflow to the pressurised water descending in the tubes such as 12.

The path of the reheated water which reaches the upper end of the annular space 10 undergoes a reversal of direction in the vicinity of the point 8*a*, so that this water redescends in the peripheral space 20 formed between the outer sleeve 8 and the outer shell 1, reheating the latter. At the bottom part of the peripheral space 20, the secondary fluid changes direction to enter the zone 21 located below the ring 11, and then to be brought up into the vaporization chamber between the inner sleeve 9 and the shaft 15. The wet steam then reaches the zone 17 and is superheated in contact with the upper part 23 of the tube bundle, the height of which is calculated according to the degree of superheating which it is wished to attain. Finally, therefore, it is superheated steam which is emptied through the passage 2*b* at the centre of the top head 2 towards a utilisation installation.

As the bottom of the outer sleeve 8 is in contact on the one hand with the reheated secondary fluid circulating in the peripheral space 20, and on the other hand with the cold secondary fluid admitted into the annular space 10, it can be advantageous at this point to arrange a thermal screen preventing the secondary fluid from recooling in the peripheral space 20. For example, for the bottom part of the outer sleeve 8, two thicknesses of sheet metal with an insulating varnish in between can be arranged. The sleeve 9, on the other hand, assists reheating of the water to a certain extent.

The steam generator according to the invention, operating with forced circulation, in a single pass, of the secondary fluid, is of generally symmetrical design with respect to the vertical axis of the machine. A certain symmetry of fabrication with respect to the median horizontal plane may also be noted.

In one particular feature of the invention the annular bundle through which the primary fluid passes consists of flexible tubes which can undergo a substantial expansion resulting from, amongst other things, pressure variations, accidental thermal shocks, etc.

Figure 3:
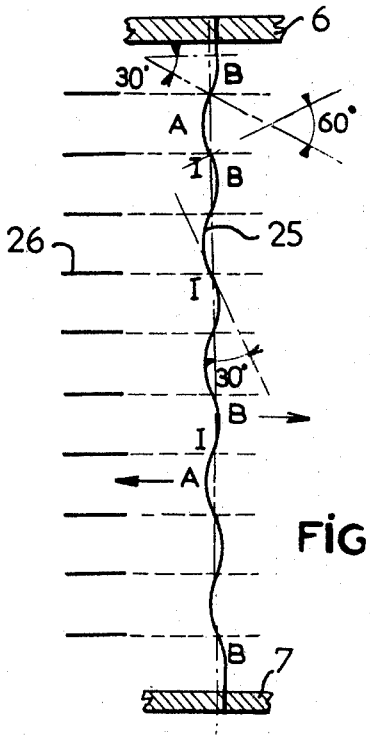
FIG. 3 represents a sinusoidal tube in elevation.

As all the tubes are identical, one has been shown as an example of one embodiment, in FIG. 3. Such a tube, numbered 25, has regular quasi-sinusoidal undulations resulting from alternate arc deflections A or B connected at points or inflection I.

It is convenient to choose for each arc an angle at the centre less than or equal to 60°. This value of 60° corresponds, in fact, to a maximum inclination of 30° of the tangent to the curve with respect to the vertical at this point. This maximum inclination occurs at the points of inflection, so that, if guide-support hoops are arranged at levels corresponding to the points of inflection, the tubes will have at these levels an obliqueness which, causing the tubes to close together, will nevertheless be compatible with a standard drilling pitch of the tube plates 6 and 7.

In the example in FIG. 3, ten deflections have been arranged, completed at each end by a half deflection and a straight portion, in addition to that which must be inserted in each of the tube plates.

Figure 4:
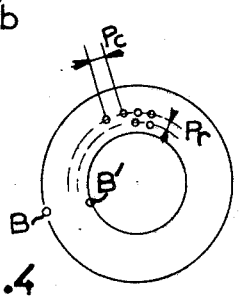
FIG. 4 shows schematically the general curvature given to a tube according to FIG. 3.

In addition to the identical sinusoidal undulations for all the tubes, in certain cases a general curvature along a cylindrical surface can be superimposed varying from one layer of tubes to the other. FIG. 4 shows in horizontal projection the curvature effected on the tubes located on the largest and smallest diameter cylinders, in the case of sinusoidal curvature according to FIG. 3. The distribution of the other tubes is made taking into account the circumferential pitch $P_c$ (spacing of the holes made in the tube plates 6 and 7 along the circumferences) and of the radial pitch $P_r$ (spacing of holes made in the same plates, along the radial directions) adopted.

In the example shown in FIG. 3 the transverse planes including the concentric tube retaining hoops, numbered generally 26, are arranged at the level of the points of inflection of the tube 25. If the inclination of the tubes with respect to the hoops 26 is at a maximum at these points, in return, the shift of the tubes under the effect of a temperature variation there is practically nil.

Figure 5:
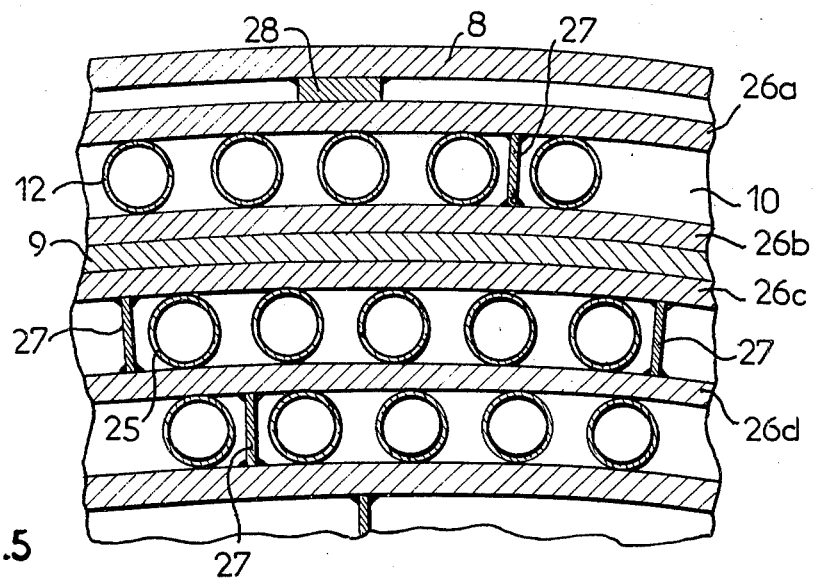
FIG. 5 shows in horizontal section the arrangement of the tubes in the guide-support hoops.
Figure 6:
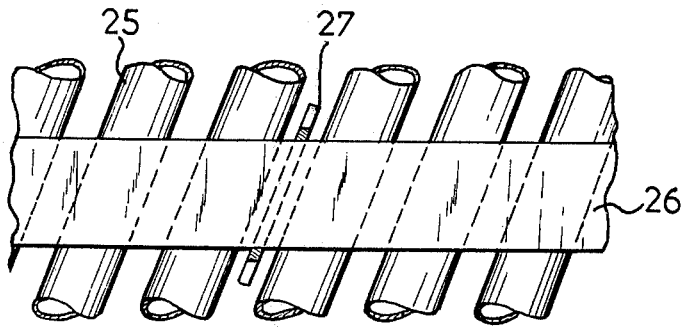
FIG. 6 represents schematically in elevation passage of the tubes at the level of a guide-support hoop, at the points of inflection of the tubes, where the obliqueness is at a maximum.

FIG. 5 which is a horizontal section in a plane of hoops show how the tubes are held and enables it to be explained how fitting is carried out according to the invention.

At 8 and 9 the outer and inner sleeves respectively can be seen, forming between them the annular space 10. In this space, a first guide-support 26*a*, to which are welded, at regular intervals, braces 27, is positioned at a suitable spacing, owing to spacing pegs 28, welded in advance to the outer sleeve 8 and on to which is welded next the hoop 26*a*. Then the tubes 12 of the reheater are put into place against the hoop 26*a* and between the braces 27 and also against the similar hoops and between the similar braces located in the various horizontal planes. For example, the circumferential spacing of the braces 27 can be such that five tubes are arranged between two successive braces. The pegs 28 are intended to increase the passage section in the annular space 10 of the reheater in order to achieve optimal speed of flow conditions.

Then the hoop is installed at 26*b* and welded to the braces 27 of the previous hoop, so that the tubes 12 are pressed between the two concentric hoops.

Beyond the inner sleeve 9, the procedure as explained previously is followed step by step going from the outside to the inside of the device, i.e.:

positioning of the hoop 26*c* to which are welded the braces 27, installation of the tubes 25 between the braces, positioning of the hoop 26*d*, fitted with braces, and which is welded to the braces 27 of the previous hoop 26*c*, etc.

Figure 8:
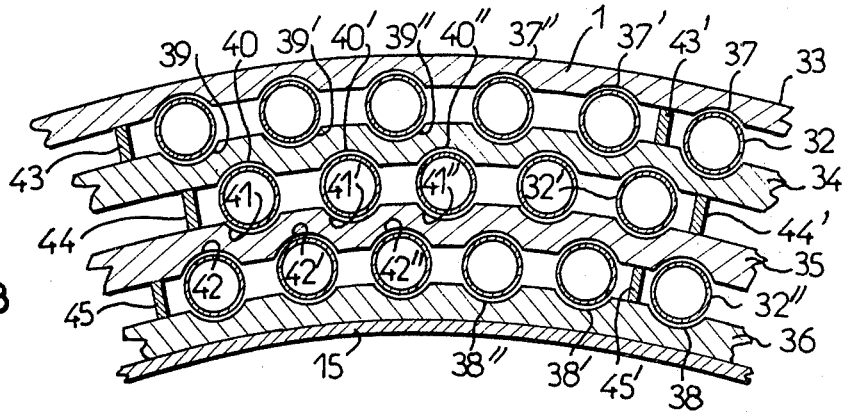
FIG. 8 represents in cross section another way of fitting the tubes with play in the retaining hoops.

As FIG. 8 shows, the braces 27 are inclined on the horizontal plane of the hoop 26 at the same angle as the tubes at this level.

Finally, the annular tube bundle unit is accessible from the shaft 16 for the purpose of repair or replacement of damaged tubes, or even replacement of the whole bundle.

The possibility of carrying out these repairs forms a considerable advantage when taking into account the very high price of devices of such a size.

The design of the steam generator according to the invention means that the higher the power the more the advantages offered. It can be used, for example, for electrical powers in the order of 300, 600 MW or even more, because the generator according to the invention, while offering maximum security of good performance with regard to any thermal accident nevertheless has every possibility of servicing to put it back into perfect working order with a minimum of operations.

Figure 7:
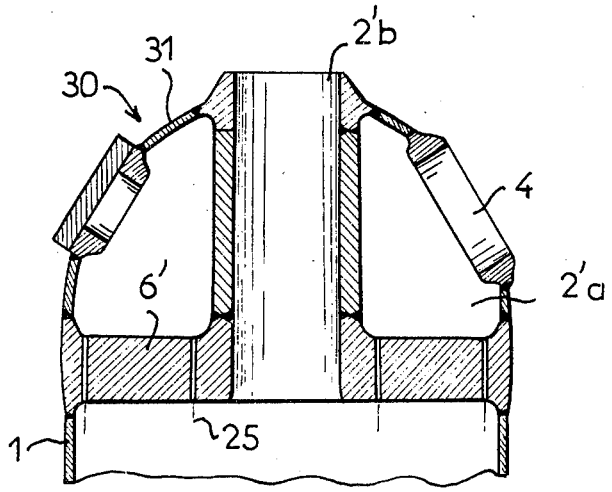
FIG. 7 shows an alternative embodiment of the generator heads, these heads being hemispherical in shape.

Instead of providing for straight heads as shown at 2 and 3 of FIG. 1, hemispherical heads can also be adopted as in FIG. 7.

A hemispherical head 30 has the advantage of leading to a lighter construction by the possible adoption of a lesser thickness of the wall 31. It has the disadvantage of not allowing easy access to the tube unit passing through the two tube plates such as 6′ to carry out possible retubing. Of course, the hemispherical head forms an annular chamber 2′*a* making a central passage 2′*b* for draining off the steam.

Another method of fitting the tubes between the hoops is shown in FIG. 8 where to simplify matters only three consecutive layers of tubes 32,32',32'' are shown . . . held by four loops 33, 34, 35, 36 the outermost hoop 33, of greatest diameter, of which is welded to the outer shell 1 of the exchanger, whilst the innermost hoop 36, having the smallest diameter, is welded to the wall 15 of the central cylindrical shaft 16. The outermost hoop has on its inner face notches such as 37,37',37'' . . . in the shape of cylindrical sectors whilst the innermost hoop 36 has similar notches 38,38',38'' . . . on its outer face, the intermediate hoops 34, 35 having similar cylindrical notches on both their faces, 39,39', 39'' . . . 40,40',40'' . . . 41, 41',41'' . . . 42,42',42'' respectively. These cylindrical notches have a slightly greater diameter than the tubes and the hoops are interlocked, by welded radial braces such as 43,43',44,44',45,45' the length of which is chosen so that a suitable minimum play remains between the hoops and the tubes ensuring that the latter are held so as to prevent vibrations.

If the retaining planes, P,P',P'' . . . in which the retaining hoops 19 . . . 22 are placed are arranged as described above at the level of the points of inflection of the tubes, these notches 37 . . . 43 must be made obliquely, which represents a complication which is eliminated in another method of fitting which will be described below.

Figure 9:
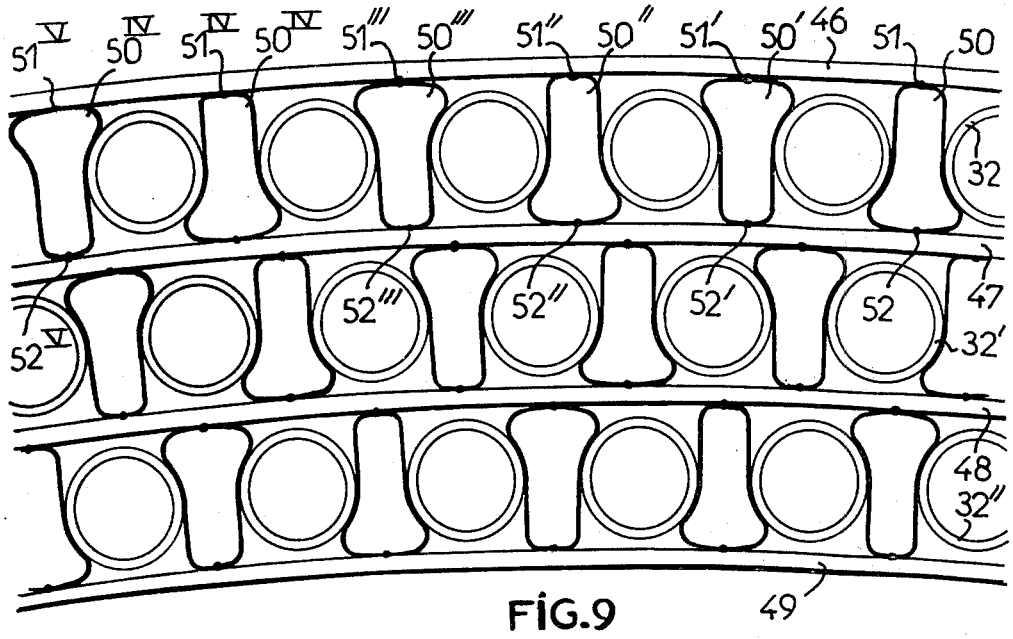
FIGS. 9 and 10 represent respectively in cross section and elevation a second embodiment of the device for holding the tubes at their points of inflexion by means of tubular braces.
Figure 10:
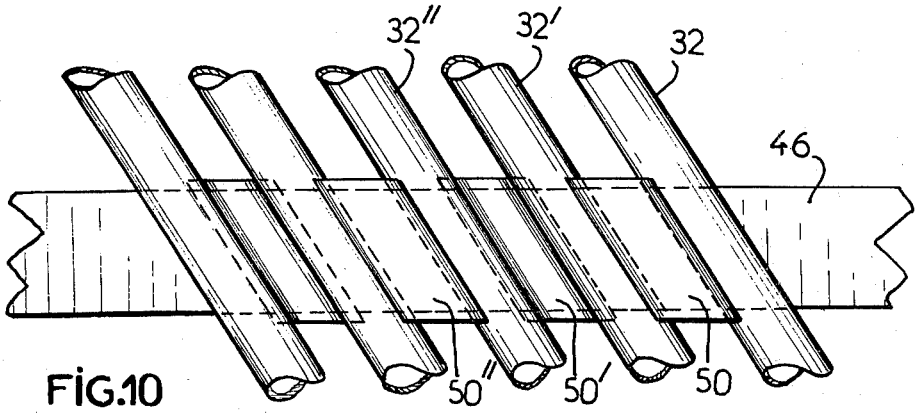

In the embodiment shown in FIGS. 9 and 10 the layer of tubes 32,32',32'', are not fitted directly between the hoops. These hoops consist of flat curved strips with a thickness in the order of 3 mm and a width of 3–4cm, the outer and inner most hoops 46 and 49 respectively being welded as in the previous embodiment to the cylindrical shell 1 and the central shaft 15. Between two hoops intended to hold a circular layer of tubes 6 are arranged tube braces such as 50,50',50'' . . . made by shaping and welding from very long strips of sheet steel of a thickness in the order of 1–2 mm and then cut to the desired length (FIG. 10). These braces have slightly convergent concave lateral faces and the two adjacent braces of each row are fitted top to bottom so as to form a housing for the tube arranged between them with a suitable play as above. These braces habe convex outer and inner faces and they are welded by points by the tops 51,51',51'' . . . 52,52',52'' . . . to the two covers between which they are positioned. In order to facilitate fitting, these tube braces are welded alternately by their wide convex bodies to the outer and inner hoops between which they are arranged; for example, the braces 50, 50'' and 50$^{IV}$ are welded by their wide outer convex faces to the hoop 46, while the braces 50',50'',50$^{V}$, the wide faces of which are turned inwards, are welded to the inner hoop 47; thus it is possible to weld these braces to the hoops in advance, before proceeding to fit them into the device. However, once the inside hoop 47 is in place, the braces 50', 50''',50$^{V}$ are also welded to this hoop at 52',52''',52$^{V}$. Given that in this case the connection of two adjacent hoops is only made by every other brace, i.e. those which are welded to two adjacent hoops, the other braces, welded only to the inside hoop of a pair, can be made from a sheet which is thinner, for example 1 mm thick, more flexible, more elastic and capable of deformation when necessary, allowing in particular greater tolerances in the diameter of the tubes during manufacture.

In another improvement to which the invention relates, these hoops can consist of straight flexible elements for example six per hoop, which are engaged inside each other at their ends which are suitably shaped for this purpose and which are curved and welded to each other when they are put into place inside the device.

In order to increase the solidity of the unit the inside hoop, welded to the central shaft 15 can be slightly thicker than the intermediate hoops which may be formed by assembling flexible flat elements.

This embodiment of the tube bundle is particularly advantageous in the case of exchangers in which the fluid circulating in the annular exchange chamber along and around the tubes has a substantial flow, because the passage section of this annular chamber is relatively slightly diminished by the flat thin hoops and the thin tube braces; in this way it is seen that the speed of passage of the fluid for a given flow is increased at the very most by 30–50% with respect to the dominant speed of the same fluid through the sections which are only occupied by the tubes. This gain is particularly marked with respect to the standard arrangement in which the tubes of the bundle occupying the whole section of the exchanger are fitted into drilled plates when the speed of passage of the fluid through these obstacles is more than doubled with respect to the speed which it would have, for the same flow, through a section occupied only by the tubes.

Thus it may be noticed with regard to FIG. 8, in the case where the planes of the retaining hoops are at the level of the points of inflection of the undulating tubes, the tube braces 50 must be arranged obliquely with respect to the vertical direction, as shown in FIG. 10, which makes it necessary to cut obliquely the pressed tubes from which they are formed.

Figure 11:
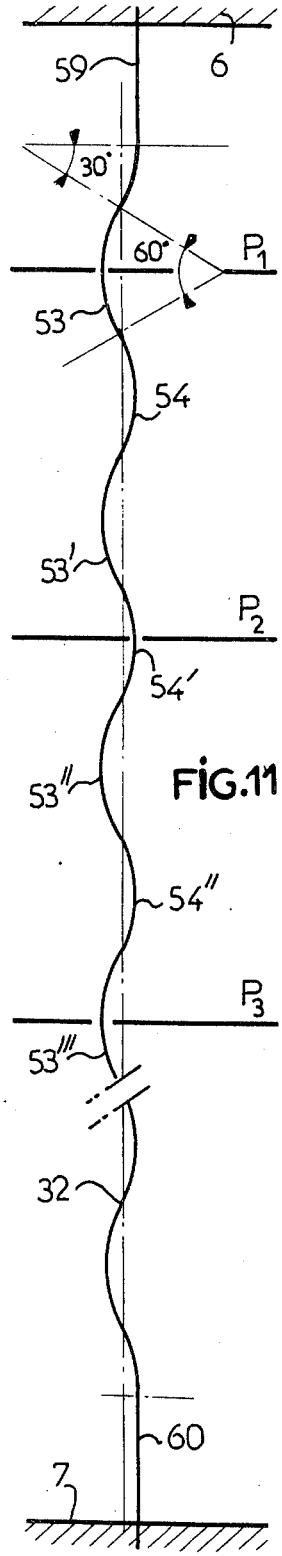
FIGS. 11 and 12 represent schematically an undulating tube held at the peaks of its undulations.
Figure 13:
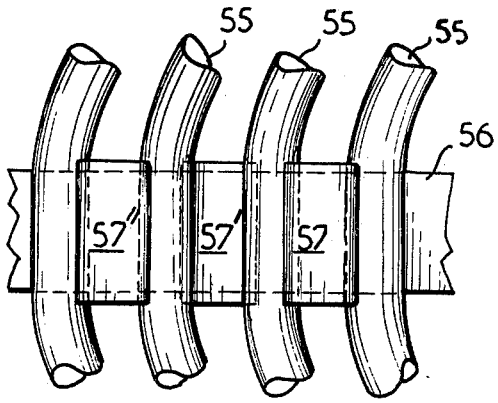
FIG. 13 represents the use of tubular braces in the case in which the tubes are held by the hoops at the peaks of their undulations.

In another method of fitting the undulating tubes of the bundle which is schematically represented in FIG. 11, these tubes 6 are no longer held in planes located at the level of their points of inflection, but in planes such as $P_1$, $P_2$, $P_3$ . . . located at the level of the peaks of the undulations formed by curved parts 53,53',53'' – 54,54',54'' . . . consisting of arcs formed with angles of deflection of 60°. In this case, in order to allow free expansion of the tubes in the longitudinal direction, the retaining planes are located at the level of the peaks 53,54',53''' of the undulations on the two opposite sides of the axis of the sinusoid, whilst the undulations such as 54 and 53' between the previous ones are free and the longitudinal expansion of the tubes means an increase in their camber. In order to be able to use straight braces, as shown in FIG. 13, the parts of the tubes forming the peaks of the undulations 55,55',55'' . . . are left straight during curving over a height of 3–4 cm corresponding to that of the retaining hoops 56 and the tube braces 57,57',57''. . . the ends of which can thus be cut perpendicularly to their axes.

Figure 12:
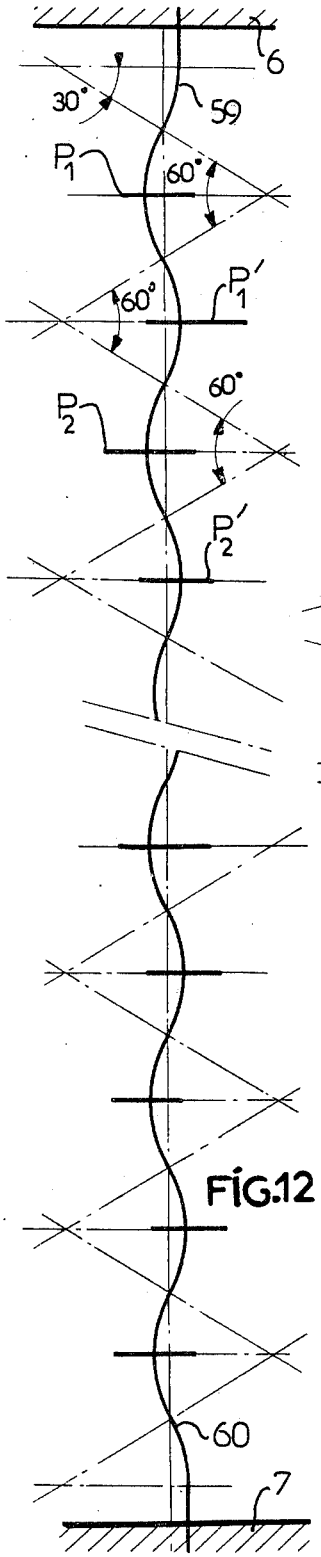
Figure 14:
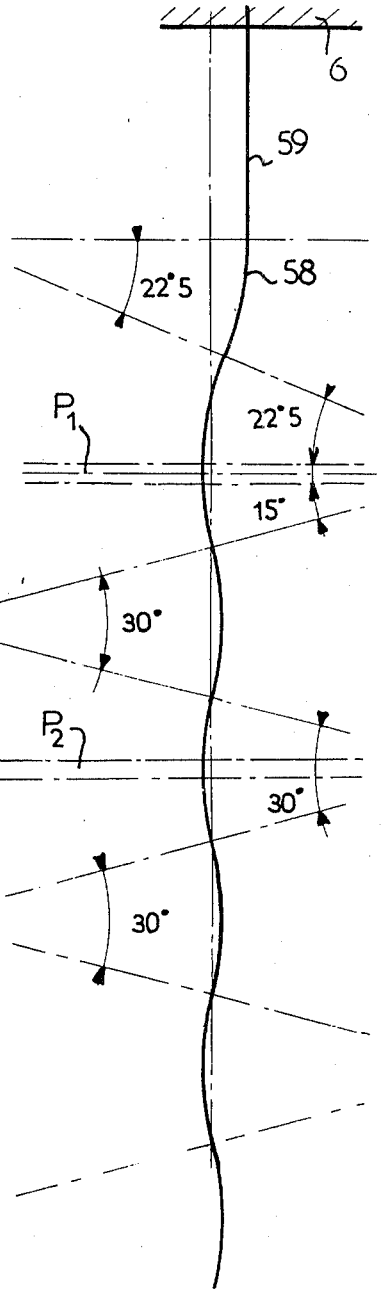
FIG. 14 represents another embodiment of such a tube.

In an alternative shown in FIG. 12, the retaining hoops are arranged in the planes of the peaks of all the undulations of the tubes, also, therefore, at the peaks such as $P'_1$, $P'_2$, located on the same side as the embedded straight parts 59,60. This arrangement improves the behaviour of the tubes with regard to vibrations which may be caused by twisting of the tubes, without increasing the expansion stresses, the tubes being capable of deformation in the two half-undulations located on either side of their immobilised peaks.

The general curvature of the undulations of the tubes can be reduced by giving a greater curvature to the parts of the tubes corresponding to the last half-undulation 58 before the top end 59 and/or bottom end 60 of the tubes embedded in the annular drilled plates 6,7 of the heads 2,3 of the device, or fixed into these plates. For example, this last half-undulation will have an angle of deflection of 45° whereas all the other undulations have an angle of deflection of 30°.

In another aspect of the invention also shown in FIG. 11 the straight ends 59,60 of the tubes 32 which are embedded in the plates 6,7 or fixed into their inner faces, are in alignment. Owing to this arrangement, the tubes can be much more conveniently fitted into the device. Indeed, each tube can be fitted with its plane arranged radially and after the ends of the tubes are slotted into the corresponding holes in the plates 6,7 the entire tube is pivoted about an axis 59,60 to bring it into the position which it has to occupy in the circular layer to which it belongs and in which it is immobilised.

In one alternative the tubes of successive circular layers are arranged so that they cross for example at their points of inflection, which increases the rigidity of the unit and is of some interest from the point of view of heat transfer.

The undulating tubes, the retaining hoops and the tube braces are preferably made of the same metal, for example stainless steel, so as to make the entire unit more homogeneous.

Figure 15:
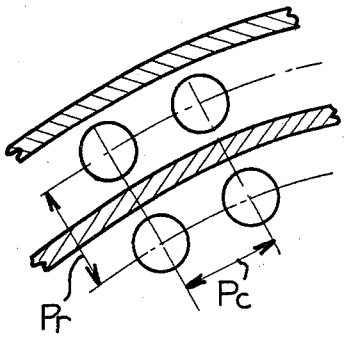
FIG. 15 represents in cross section a fragment of a tube bundle according to the invention illustrating the choice of radical pitch and circumferential pitch of the tubes.

An important practical detail lies in the choice of the distance between axes of tubes of the same circular layer which is called 'circumferential pitch' of the tubes in the main patent and the distance between axes of two adjacent circular layers, which is called 'radial pitch'. If $P_r$ is the radial pitch, $P_c$ the circumferential pitch (as shown in FIG. 15) and $n$ the increase in the number of tubes from one layer to the next (going from inside to outside), the obvious equation is obtained:

$$2\pi P_r = nP_c$$

since each layer has a circumferential length greater by $2\pi P_r$ (i.e. $2\pi x$ the increase in the radius) than that of the previous layer. Thus the ratio of the two pitches is:

$$\frac{P_r}{P_c} = \frac{n}{2\pi}$$

If $n$ is given the value 6, the two pitches become more or less equal and an arrangement close to that shown in FIG. 8 is obtained which corresponds to a minimal value of the radial pitch at the same time as a good distribution of the flow of fluid between the tubes. Thus the number of tubes from one layer to the next can be increased by the same amount which considerably simplifies the design of the device.

Figure 16:
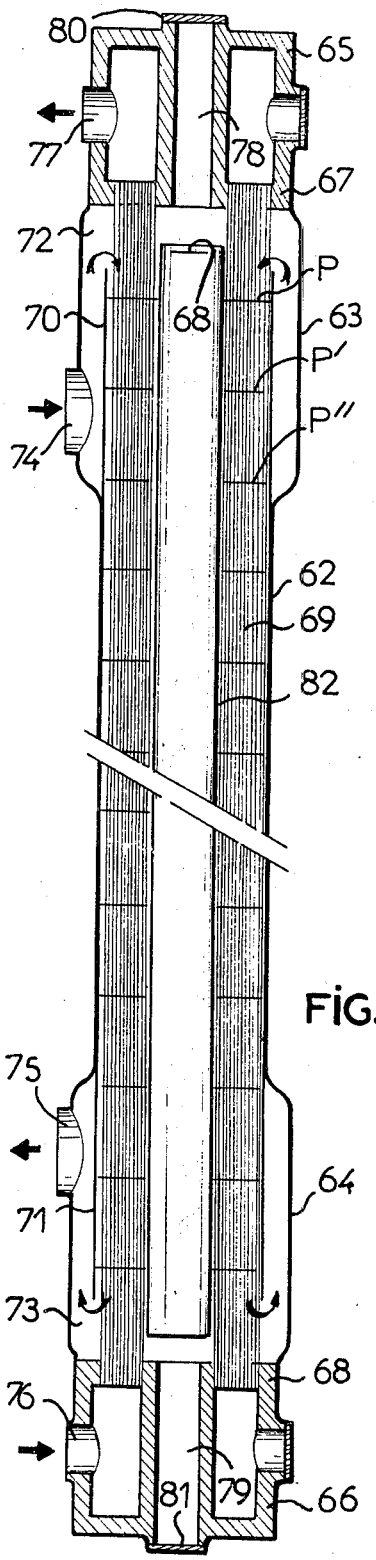
FIG. 16 represents an embodiment of an exchanger according to the invention in the case in which the heat-carrying fluid is a liquid metal such as sodium.

FIG. 16 shows an embodiment of the exchanger according to the invention corresponding to a very important special application in which the heat-carrying fluid is a liquid metal such as sodium. As the vapour pressure of the liquid sodium is negligible even at very high temperatures it can be brought into the generator at a temperature in the order of 500° to 550° C under a low pressure. In addition, as the surface transfer coefficient of a liquid metal, and of sodium in particular, is better than that of pressurised hot water, its speed of circulation in the exchanger can be reduced, taking for example a speed of 1.5 m to 2 m per second instead of 5 m per second for pressurised water. In these conditions it is advantageous to make the liquid sodium circulate in the annular exchange space along and between the tubes, which, owing to the arrangement described above of the retaining hoops and tube braces, has a greater passage section, whilst the water to be vaporised will circulate in the tubes, which enables greatly superheated steam under high pressure to be obtained in the safest conditions. Because of the low pressure of the sodium, the cylindrical walls bounding the annular exchange chamber are less thick.

In addition the relatively low speed of circulation of the liquid sodium, as well as the reduction in pressure losses owing to the large passage section available, enables the size of the sodium pumps, which are very expansive pieces of equipment, to be reduced as well.

The liquid sodium steam generating exchanger shown in FIG. 15 consists of a cylindrical outer wall 62 with cylindrical bulges 63,64 at the top and bottom integrally connected respectively to the annular cylindrical heads 65,66 in the annular base plates 67,68 from which the undulating tubes of the annular bundle 69 are embedded or fixed, this being held in the way described above by concentric hoops and braces arranged in the planes, P,P',P'' . . . these retaining devices being fixed as previously on the one hand to the central shaft 82 and on the other hand in the central part of the device, on to the cylindrical shell 62, and, in the bulging parts, 63, 64 of this to two sleeves 70,71 arranged in these bulges as an extension to the shell 62 with a height such that a passage 72 is formed for the entry into the annular exchange chamber of the liquid sodium brought into the device through the pipe 74 on the upper bulging part 63 and a passage 73 through which the sodium leaves the exchange chamber to be drained off through the pipe 75 on the lower bulging part 64. The water to be evaporated enters the lower head 66 by the pipe 76 and the high pressure steam is emptied through the pipe 77 of the upper head 65. The sleeve 70 and 71 serve as deflectors guiding the sodium into and out of the annular exchange space. The fact that the annular plates 67,68 on which the tubes of the bundle are fixed from the bottom of the tube heads 55,56 protects them against any deformation because they are held both on the periphery and in the centre by the outer and inner cylindrical walls of these heads. Owing to this arrangement it is possible to give the annular plates 77,78 a relatively low thickness whilst keeping their perfect mechanical rigidity.

The central tubular pasages 78,79 of the heads 65,66 are closed by doors 80,81 which allows access inside the device in case of need.

The arrangement adopted enables the risks of accidents which may be caused by leaks putting the sodium in contact with the water to be reduced as far as possible, because the overpressure caused by the hydrogen thus released is then at least partially absorbed by the volume of the central shaft 82. In addition rupture discs are arranged housed in the top and bottom doors 80,81 and in the shutter 73 of the central shaft 72 to drain off the overpressure should it occur.

Summarising, the heat exchanger according to the invention enables the following combination of advantages to be obtained, some of which are to be found in isolation in the various known exchangers mentioned at the beginning of the present description and others of which, the greater part, are entirely new:

1. Accessibility of the central part of the device over its entire height facilitating fitting of the tube bundle and allowing repairs and replacement of the tubes in situ without touching the outer structure of the device.

2. Completion of the heavy outer structure of the device (assembly, installation, welding and stabilisation of the outer shell and of the top and bottom heads) before fitting the tube bundle, the durability of which is not influenced by the annealing treatment of the heavy structure which is necessary for the supression of the internal tensions produced by welding the parts of this structure.

3. Possibility of using undulating tubes reducing the thermal stresses of bends in these tubes to the safety value fixed according to the accident maximum of the temperature difference between the tubes and the outer shell.

4. Reduction temperature about 30–40% in the drilled plates into which the ends of the tubes are fitted as a result of embedding the top and bottom heads in the outer cylindrical part and in the central tubular part of the device; this reduction in thickness of the plates reduces the value of the temperatur gradient in these plates and also therefore the thermal stresses. In addition, the difference in temperature between the two faces of the lower plate, the upper face of which is in contact with the already pre-heated water, is reduced.

5. The cold water to be vaporised enters the reheater between two sleeves of low thickness bounding this reheating in such a way that the temperature of the two faces of the sleeves rapidly attains the same value.

6. The device directly produces superheated steam with no extra equipment.

7. The superheated steam leaves the machine by an axial outlet from the top head, which simplifies the shell which has a less bulky, simple cylindrical shape.

8. Because of the increase in the passage section into the annular exchange chamber for the fluid circulating outside the tube, the pressure losses are reduced.

9. An appreciable saving is made on the materials because it is no longer necessary to use INCONEL.

10. Finally, a substantial saving is made on the regulating and control devices.

I claim:

1. A large size heat exchanger operating at a high temperature and pressure, particularly of the type used as a steam generator wherein the primary hot fluid consists of the cooling fluid of a nuclear reactor wherein a bundle of heat exchange tubes is arranged in a container, said exchanger comprising:

a. a outer heavy structure including an outer cylindrical shell, an upper head having an outer wall and an inner coaxial wall defining an annular chamber therein and a large central passage, an annular base plate closing the lower end of said chamber and having a plurality of circular rows of perforations, a lower annular head having a shape similar to the upper head and arranged symmetrically relative thereto, whereby its inner coaxial wall defines a large central passage allowing access to the interior of the structure for mounting and repairing said bundle of tubes in situ, removable closing means for closing said passage, the outer wall of each of said heads being provided with an aperture for the intake and the outlet of the fluid circulating through said tubes, said structures having inlet and outlet apertures for a second fluid circulating along the tubes, said outer heavy structure being assembled, welded and stabilized by annealing before the mounting of said tubes, b. a light inner structure comprising an annular bundle of alike axially undulated planar tubes having a quasi-sinusoidal shape, having successive arcuate deflections in opposite directions with an angle of deflection in the order of 60°, said tubes being arranged in a plurality of circular tube layers and having their upper and lower ends inserted in the perforations of the corresponding annular base plates of said heads and welded thereto, said bundle of tubes comprising a plurality of series of concentric annular supporting hoops arranged on different axially spaced supporting planes respectively, a pair of concentric hoops being arranged eitherside of each circular layer of tubes, each hoop consisting of a plurality of flexible linear elements engaged with one another end-on-end, curved and welded to each other as they are fitted within the outer structure, radially extending tubular braces having concave lateral faces and each inserted between a pair of adjacent tubes in each supporting plane and welded to the outer and to the inner hoops of each pair of annular hoops arranged eitherside of each circular sheet of tubes respectively to firmly maintain said tubes in said planes without frictional contact between the tubes and the hoops, said tubular braces having substantially the same expansion coefficient as the tubes, the peripheral outer hoop of each supporting plane being attached to the inner surface of the outer shell and the mounting of said circular tube sheets commencing with the peripheral sheet next to the outer shell, a large central shaft made of relatively thin metal sheet arranged in the middle of the annular bundle of tubes extending over the major part of the height of said bundle, having a lower open end welded to the annular base plate of the lower head and a closed upper end to define an annular heat exchange chamber with the outer shell, the peripheral inner hoop of each supporting plane being attached to the outer surface of said central shaft, the diameter of the central free space surrounded by the annular bundle of tubes being in the order of between 1m and 1.5m to provide an access to said bundles after destruction of said central shaft for the purpose of repairing and changing said tubes.

2. Heat exchanger according to claim 1 wherein the rows of circular supporting hoops are arranged in planes containing points of inflection of the undulated quasi-sinusoidal tubes, and the tubular braces are arranged obliquely with respect to a general axial direction of the tubes.

3. Heat exchanger according to claim 1 wherein the rows of circular supporting hoops are arranged in planes containing peaks of the arcuate undulations of the tubes, said tubes being straight either side of said peaks over a few centimeters and the tubular braces being arranged parallel to said straight portions of the tubes.

4. Heat exchanger according to claim 1, wherein the undulated tubes of the adjacent circular layers of tubes cross one another at the levels of their points of inflection.

5. Heat exchanger according to claim 1, wherein the tubular braces are made of a thin metal sheet having a thickness on the order of 1 to 2 mm and have a wide convex base and a narrower opposite convex base, said convex bases being connected by concave and slightly convergent lateral faces, and successive braces being placed alternately having a wide base thereof disposed radially outwardly and radially inwardly and welded to the supporting hoops by the peaks of their convex bases.

6. Heat exchanger according to claim 5 wherein the tubular braces inserted between the tubes of each layer of tubes are welded by their wide convex bases alternately to the outer and to the inner hoop arranged either side of said sheet of tubes.

7. Heat exchanger according to claim 5 wherein the alternating braces placed in one direction are welded before mounting of the hoops by the peaks of their wide convex bases to the inner side of the supporting outer hoop of each layer of tubes, whereas the alternating tubular braces placed in the opposite direction are welded by the peaks of their wide convex basis to the outer side of the inner supporting hoop of said layer.

8. Heat exchanger according to claim 5 wherein alternate tubular braces arranged between two adjacent supporting hoops are alternately welded to both hoops and the others to only one of the hoops, the other braces being made from a thinner sheet metal than said first mentioned braces and being capable of deformation when the tubes are put into place.

9. A large size heat exchanger according to claim 1 wherein the primary hot fluid consists of the pressurized cooling water of a nuclear reactor, said pressurized hot water being admitted through the aperture provided in the outer wall of the upper head to circulate through the tubes and being evacuated through the aperture provided in the outer wall of the lower head, whereas the water to be vaporized circulates in counter flow and in forced circulation along the tubes in the exchanger chamber and the steam therein generated is evacuated through the central passage of the upper head, said exchanger comprising inside of the outer cylindrical shell a concentric double sleeve defining a first annular space between the outer sleeve ans the outer shell and a second annular space between both of said sleeves in which is arranged at least a peripheral layer of tubes of the annular bundle, the inner sleeve having an upper end attached to the upper annular head and an upper end of the outer sleeve terminating at a distance from said upper head thereby providing communication between said two annular spaces whereas lower ends of both said sleeves terminate at a distance above the lower annular head of the exchanger, a ring attached to said lower ends of said sleeves and closing the lower end of said second annular space, said ring having perforations through which pass the tubes of the tube layer arranged in said space, communication being thus provided between the outer annular space and the heat exchange chamber containing a major portion of the tube bundle, and means for injecting the water to be vaporized in the lower portion of the annular space formed between said sleeves, said water circulating from the bottom to the top of said annular space where it is preheated by the primary fluid circulating in the tubes disposed therein from top to bottom, and the preheated water circulating then from top to bottom through the annular space between the shell and the outer sleeve to enter the annular exchange chamber where it circulates from bottom to top and is vaporized by the heat provided by the primary fluid, whereby the generated steam is overheated in the upper part of said heat exchange chamber before leaving the exchanger through the central passage of the upper annular head.

10. A large heat exchanger according to claim 1, in which said outer cylindrical shell has two enlarged portions provided in upper and in lower end portions of the outer cylindrical shell respectively, two sleeves welded to a lower edge of the upper enlargement and to an upper edge of the lower enlargement respectively and terminating at a distance from the upper head and the lower head respectively thereby providing communication between said enlargement and an annular heat exchange chamber defined between the shells and said sleeves and said central shaft, said upper enlargement having a lower part provided with an inlet for liquid sodium, means defining an outlet for said liquid sodium on an upper part of said lower enlargement, whereby the liquid sodium circulates in the heat exchange chamber from top to bottom along and around the tubes of the bundle and cold water admitted in the lower head circulates from bottom to top to deliver overheated steam evacuated from the upper head.

* * * * *